US007299872B2

(12) United States Patent
Darnell

(10) Patent No.: US 7,299,872 B2
(45) Date of Patent: Nov. 27, 2007

(54) HYDRAULIC-MECHANICAL JAR TOOL

(75) Inventor: David Trevor Darnell, Yarmouth (GB)

(73) Assignee: Weatherford/Lamb, Inc., Houston, TX (US)

( * ) Notice: Subject to any disclaimer, the term of this patent is extended or adjusted under 35 U.S.C. 154(b) by 237 days.

(21) Appl. No.: 10/496,265

(22) PCT Filed: Nov. 27, 2001

(86) PCT No.: PCT/GB01/05235

§ 371 (c)(1),
(2), (4) Date: May 20, 2004

(87) PCT Pub. No.: WO03/048511

PCT Pub. Date: Jun. 12, 2003

(65) Prior Publication Data

US 2005/0000735 A1 Jan. 6, 2005

(51) Int. Cl.
*E21B 31/107* (2006.01)

(52) U.S. Cl. ..... 166/301; 166/178; 175/304; 175/293; 173/91

(58) Field of Classification Search ..... 166/301, 166/383, 178; 175/304, 293; 173/91
See application file for complete search history.

(56) References Cited

U.S. PATENT DOCUMENTS 2,336,564 A 12/1943 Osmun
2,678,805 A 5/1954 Sutliff
3,566,981 A 3/1971 Love
3,949,821 A 4/1976 Raugust
4,007,798 A * 2/1977 Gazda ..... 175/297
4,261,427 A 4/1981 Sutliff et al.
4,361,195 A * 11/1982 Evans ..... 175/297
4,566,546 A 1/1986 Evans
4,865,125 A * 9/1989 De Cuir ..... 166/178

(Continued)

FOREIGN PATENT DOCUMENTS

EP 0 083 961 7/1983

(Continued)

OTHER PUBLICATIONS

British Search Report for GB Application No. GB 0111625.0 Dated Sep. 26, 2001.

(Continued)

*Primary Examiner*—David Bagnell
*Assistant Examiner*—Robert E. Fuller
(74) *Attorney, Agent, or Firm*—Patterson & Sheridan, LLP

(57) ABSTRACT

A jar mechanism comprises a housing having a fluid chamber therein, a piston encircled by an annular metering sleeve and movably mounted in the fluid chamber for movement between a first position and a second position, and a jar member moveably mounted in the housing such that a pull or push force exerted on the jar member moves the piston from the first position to the second position within the fluid chamber against the resistance of the fluid, and the action of the pull or push force exerted on the jar member actuates a release device. The jar member is releasably coupled to the piston by the release device such that, when the piston is in the first position in the fluid chamber, the jar member is coupled to the piston by the release device for movement therewith. Actuation of the release device enables the jar member to be uncoupled from the piston.

21 Claims, 6 Drawing Sheets

U.S. PATENT DOCUMENTS

| | | | | |
|---|---|---|---|---|
| 5,052,485 | A | 10/1991 | Reid | |
| 5,083,623 | A | 1/1992 | Barrington | |
| 5,267,613 | A | 12/1993 | Zwart et al. | |
| 5,624,001 | A * | 4/1997 | Evans | 175/299 |
| 2004/0045716 | A1 * | 3/2004 | Bakke | 166/301 |

FOREIGN PATENT DOCUMENTS

| | | |
|---|---|---|
| EP | 0 110 803 | 6/1984 |
| EP | 0 147 154 | 7/1985 |
| EP | 0 405 799 | 1/1991 |
| GB | 2 362 904 | 12/2001 |

OTHER PUBLICATIONS

PCT International Search Report for International Application No. PCT/GB01/05235, Dated Dec. 31, 2002.

* cited by examiner

HYDRAULIC-MECHANICAL JAR TOOL

The present invention concerns improvements to jar mechanisms.

Wireline is a method of lowering specialized equipment into an oil or gas well, or raising specialized equipment from an oil or gas well. The principle of wireline is to attach a workstring or toolstring to the end of a reel of wire and by reeling out the wire the toolstring is lowered into the well. By either reeling in or reeling out the wire, the toolstring can be made to perform simple tasks downhole.

The toolstring consists of a variable combination of individual tools screwed together to form a working unit. A toolstring typically comprises a rope socket, a stem or sinker bar, an upstroke jar, a spang jar and a pulling and running tool.

Conventionally, there are two distinct types of upstroke jar available on the market. The first is a hydraulic jar and the second is a mechanical or spring jar. Both types of jar have different attributes and disadvantages.

The hydraulic jar is activated only when the bottom end of the jar is anchored and the top end is subjected to a constant pulling force. For simplicity, the jar can be regarded as being a piston located in a cylinder which is filled with hydraulic oil. The piston, commonly known as the jar rod, is normally at the bottom end of its stroke within the cylinder, where the two are close fitting. Very limited fluid by-pass around the position means that it takes considerable force and time to move the piston up the cylinder. The time factor allows a desired pull force to be reached before the piston reaches the point where the internal diameter of the cylinder opens out. When the piston reaches the opened out portion of the cylinder, the pulling force accelerates the piston to the top of its stroke where it will deliver an impact force upwardly when it is stopped by the jar housing itself. The piston usually contains a small check valve to enable a fast return stroke into the small internal diameter portion of the cylinder by allowing greater fluid by-pass in that direction only. U.S. Pat. No. 4,230,197 and U.S. Pat. No. 4,181,186 disclose hydraulic jars of this type.

The advantages of hydraulic jars are that they are very versatile in use because a small pulling force will result in a small jar force and similarly a large pulling force will result in a large jar force. In addition, there is no need to remove these jars from the toolstring to adjust the release setting, as is necessary with mechanical jars. Hydraulic jars will also fire whatever the value of the pulling force that is used or is available.

However, hydraulic jars still have a number of disadvantages. As there is a seal around the jar rod itself, the ability of the jar to function depends on the life time of this seal. This seal is subjected to considerable wear and tear due to the violent motion of the jar rod. To ensure relocation of the piston back into the lower reduced internal diameter the jar rod is usually fairly short and this compromises the resulting jarring force available. Also, the whole tool is full of hydraulic oil which makes maintenance of the tool difficult.

Mechanical jars contain no hydraulic oil. The jar therefore has no seals. Again the jar can be regarded as a piston within a cylinder however this time the piston is held at the bottom end of its stroke by various mechanical mechanisms which are usually dependent on the manufacturers. Usually the mechanism comprises a coil spring or spring washer stack arrangement as part of the mechanism. The spring is used to pull against to allow the piston to be released and travel up its full stroke within the main housing of the jar when a certain known pull force is reached. This value is usually dependent on the spring rate.

The advantages of the mechanical jar are that there is no seal around the jar rod and there is an unhindered travel of the jar rod up to its full stroke, i.e. there is no hydraulic oil to be by-passed. It is also possible to obtain a larger jar rod stroke than can be achieved with a hydraulic jar.

However, there are also a number of disadvantages associated with mechanical jars. Mechanical jars must be removed from the toolstring in order to be adjusted to the desired pull force for activation downhole and the pull force at which the jar is set to fire must be applied to the jar before the jar will work. This value is often difficult to predict especially when it is used deep downhole. There is also a difficulty in maintenance due to the large number of parts which comprise the jar.

Coil tubing operations are similar to wireline operations and also use jar mechanisms to enable high impact forces to be generated by the toolstring during the coil tubing operation. However, with coil tubing operations there is the additional complexity that it is desirable to pump fluid through the toolstring during the operations, and this feature has been difficult to combine with conventional jar mechanisms.

Proposals have been made in the prior art to address these problems but these do not fully address the need for economical assembly of the jar mechanism, ease of operation and ease of maintenance.

In accordance with a first aspect of the present invention there is provided a jar mechanism which comprises a housing having a fluid chamber therein; a piston movably mounted in the fluid chamber for movement between a first position and a second position; and a jar member movably mounted in the housing; and whereby a pull or push force exerted on the jar member moves the piston from the first position to the second position within the fluid chamber against the resistance of the fluid, and the action of the pull or push force exerted on the jar member actuates the release device, the jar member being releasably coupled to the piston by a release device such that when the piston is in the first position in the fluid chamber the jar member is coupled to the piston by the release device for movement therewith and actuation of the release device enables the jar member to be uncoupled from the piston, the piston being encircled by an annular metering sleeve allowing metered flow of the fluid in the fluid chamber from one side of the piston to the other via the annular metering sleeve, the clearance between the bore of the metering sleeve and the outside diameter of the piston determining the level of resistance to movement of the jar member while the jar member is coupled to the piston.

Preferably, the piston includes a one way valve which closes and prevents unmetered fluid flow passed the piston when the piston moves from the first to the second position, but which opens and allows fluid to flow relatively freely passed the piston when the piston moves from the second to the first position. In one example, the one-way valve comprises a chamber which communicates with the fluid on either side of the piston and inside the chamber is located a spherical member such as a ballbearing which prevents fluid passing the chamber when the piston moves from the first position to the second position, but which permits fluid to pass through the chamber when the piston moves from the second position to the first position.

Preferably, the release device is movably mounted on the piston for movement between an engagement position and a release position and the release device is typically biased to an intermediate position, between the engagement and the release positions, and whereby the jar member may be uncoupled from the piston when the release device is in the release position and the piston is in the second position and whereby the jar member may be recoupled to the piston when the release device is in the engagement position and the piston is in the first position.

Preferably, when a force opposite to the first force is applied to the jar member, the jar member causes the release device to move to the engagement position and the piston is moved from the second to the first position so that the release device couples the piston to the jar member.

Alternatively, the jar mechanism may comprise means to retain the piston in the second position when the jar member is uncoupled from the piston. In this example the means to maintain the piston in the second position comprises a biasing means such as a helical spring.

Particularly preferably, the jar member is a jar rod having a shaft with an acircular cross section to at least part of the shaft and wherein the jar rod shaft passes into an anvil sub of the jar mechanism through an aperture in the anvil sub, the part of the jar rod having an acircular cross section being able to lodge against one or more shoulders or faces within the anvil sub whereby a turning force applied to the jar rod may be transmitted to the anvil sub if required.

Suitably the aperture of the anvil sub through which the jar rod shaft passes into the anvil sub has a bore with a corresponding acircular shape to the shape of the acircular cross section part of the jar rod shaft.

Suitably the acircular cross section part of the jar rod shaft extends for only part of the length of the jar rod shaft whereby the jar rod shaft is air ducted to engage with the anvil sub only for a pre-defined part of the range of axial positions of the jar rod relative to the anvil sub.

Preferably where the jar rod shaft and anvil sub have complementary shapes to co-operatively engage for transmission of torque, one or both of the jar rod shaft and anvil sub are provided with one or more longitudinal recesses or channels to allow for bypass of fluids.

In accordance with a second aspect of the present invention there is provided a jar mechanism which comprises a housing having a fluid chamber therein; a piston movably mounted in the fluid chamber for movement between a first position and a second position; and a jar member movably mounted in the housing; and whereby a pull or push force exerted on the jar member moves the piston from the first position to the second position within the fluid chamber against the resistance of the fluid, and the action of the pull or push force exerted on the jar member actuates the release device, the jar member being releasably coupled to the piston by a release device such that when the piston is in the first position in the fluid chamber the jar member is coupled to the piston by the release device for movement therewith and actuation of the release device enables the jar member to be uncoupled from the piston, the jar mechanism further comprising a balance piston facing the fluid in the fluid chamber and which operates to accommodate for any expansion of the fluid.

Typically, the jar mechanism may be used as a wireline jar for wireline operations, or as a pump through jar for coil tubing operations in aborehole.

Preferred embodiments of jar mechanism will now be more particularly described, by way of example, with reference to the accompanying drawings, in which:—

Figure 8A:
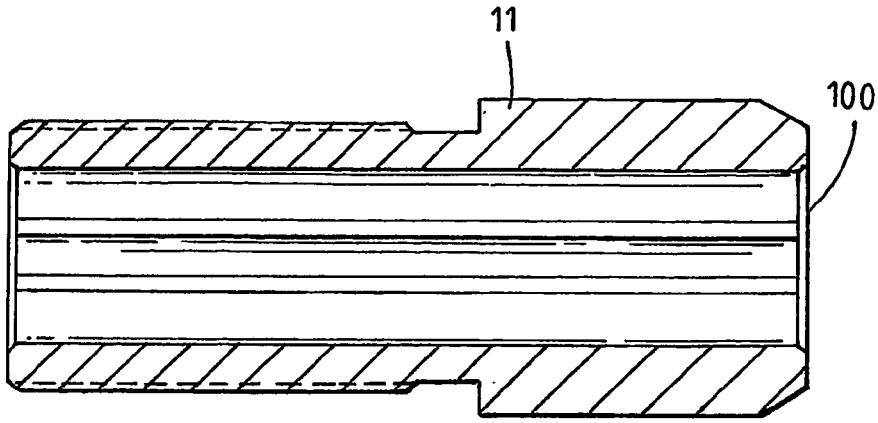
Figure 8B:
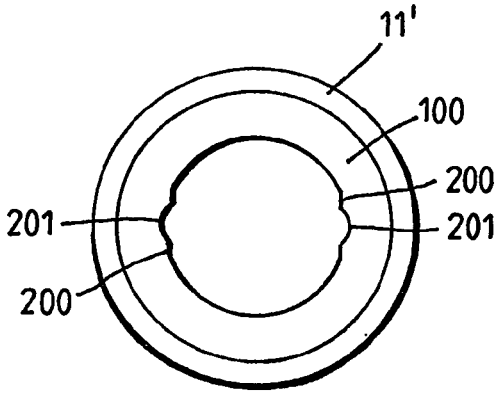
Figure 9A:
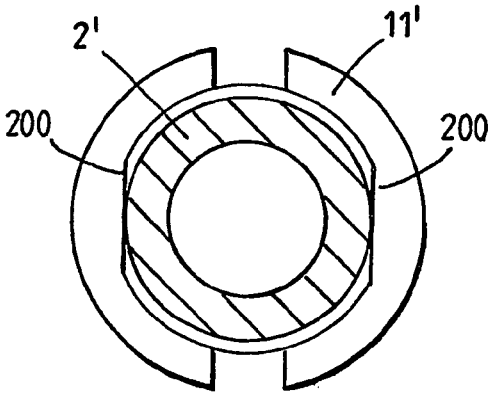
Figure 9B:
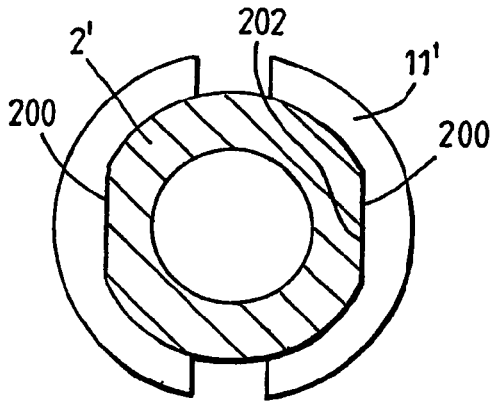

FIG. 8A is a longitudinal sectional view of an anvil sub of a further preferred embodiment of the invention and FIG. 8B is a cross sectional view of the same; and FIG. 9A is a cross sectional view through an anvil sub with jar rod installed therein and showing the jar rod in a first longitudinal position relative to the anvil sub in which there is no rotary co-operative engagement of the jar rod with the anvil sub, whereas FIG. 9B is a cross sectional view with the jar rod moved to a longitudinal position at which there is rotary co-operative engagement.

Figure 10:
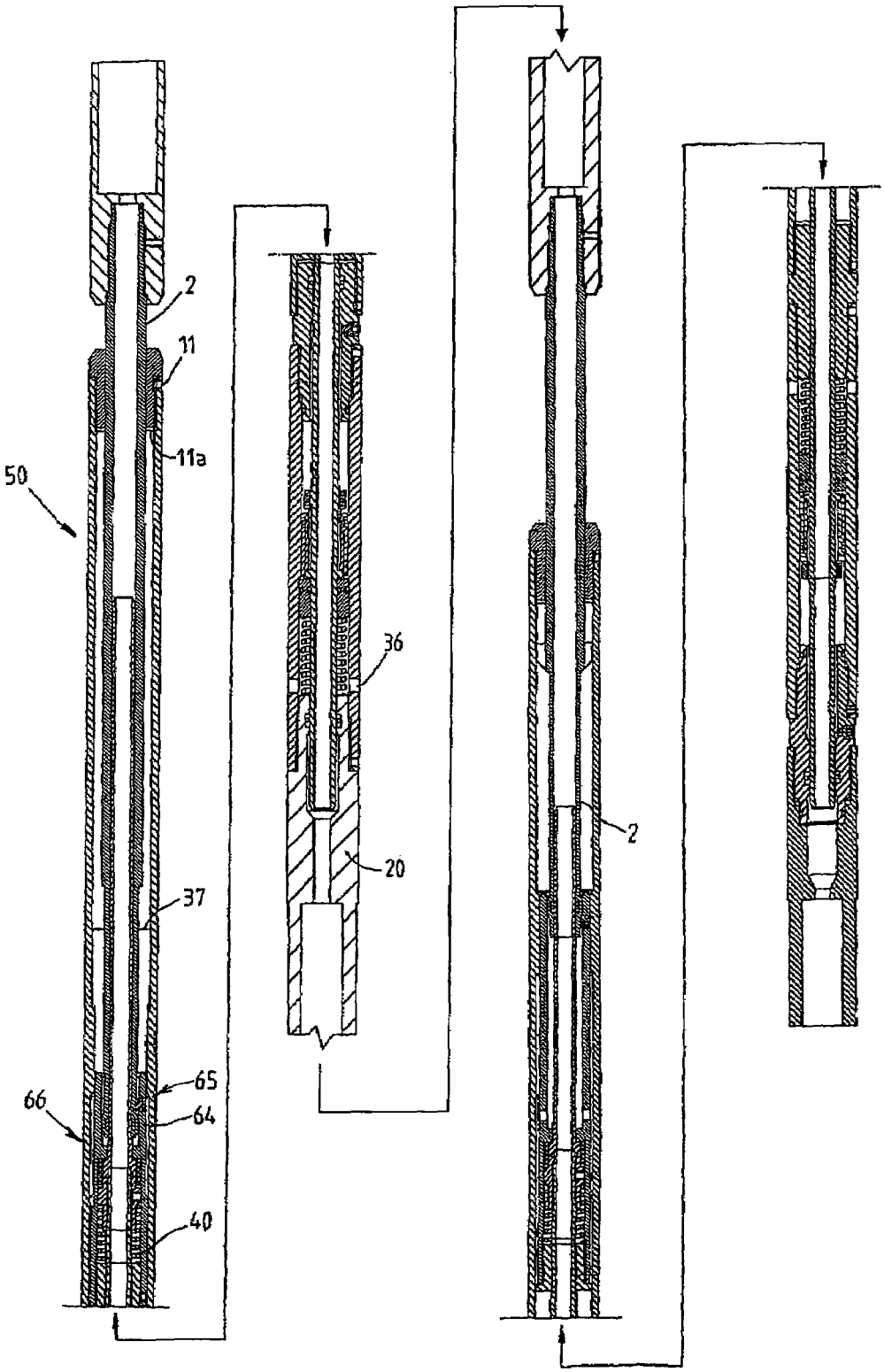

FIG. 10 is a longitudinal sectional view of an embodiment of a dual stroke iar.

Figure 1:
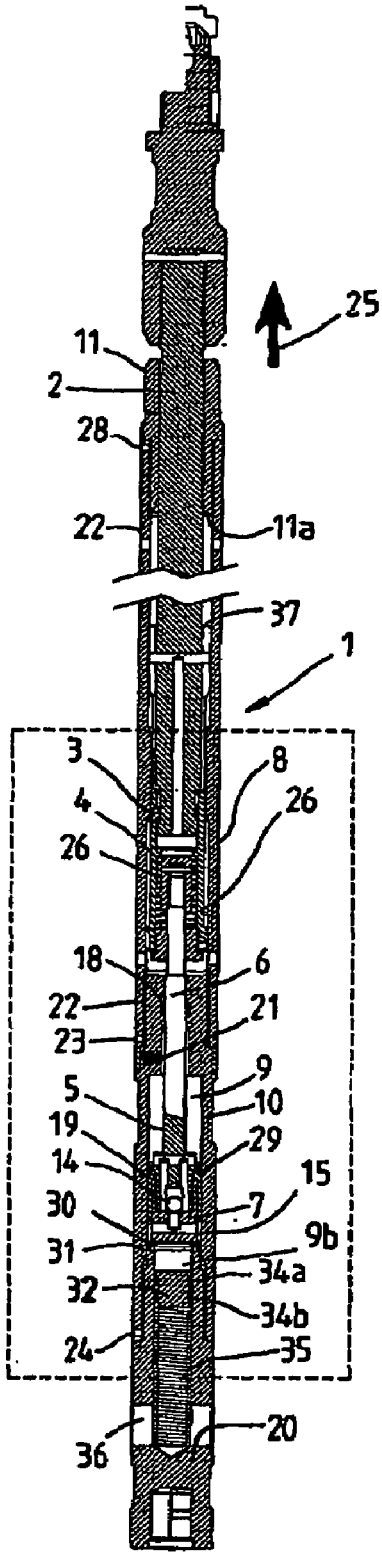
FIG. 1 is a longitudinal sectional view of a first preferred embodiment of upstroke jar showing the jar mechanism in the primed position.

FIG. 1. shows an upstroke jar I for use in wireline operations which comprises a jar rod 2 which is releasably secured via a latch key 3 and a latch sub 4 to a piston 5. The piston 5 comprises a piston shaft 6 and a piston body 7 of upper and lower parts 7*a*, 7*b* coupled together and the latch sub 4 is secured to the piston shaft 6 by means of a roll pin 8.

The piston shaft 6 and the piston body 7 are secured together within a fluid chamber 9 located in a piston housing 10. The fluid chamber 9 contains a fluid such as hydraulic oil although any other suitable gas or liquid could be used. The piston 5 has a chamber 12 therewithin and within which is located a one way valve which comprises a ball 14. Fluid may enter into the chamber 12 via the two passage ways 15, 16 in either end of the piston body 7 and which communicate with the fluid chamber 9 and the internal piston chamber 12.

O ring seals are provided to prevent leakage of the fluid from the fluid chamber 9. The O ring seal 18 is coupled with a carbon filled PTFE backup ring and prevents leakage of the fluid between the piston housing 10 and the piston shaft 6.

A bleed screw 21 is located in the piston housing 10 and this is used to prevent an air lock forming in the fluid chamber 9 when the jar 1 is being assembled. The jar 1 also comprises a main body housing 22 which is attached to the piston housing 10 by means of a locking screw 23. A bottom sub 20 is connected to the lower end, in use, of the piston housing 10 by a locking screw 24 and has an O-ring seal 31 at the joint.

The piston body 7 is encircled by an annular fluid metering sleeve 19 which is held captive on the piston body 7 to move with the piston body 7 but which sealingly engages the bore of the piston housing 10 by an O-ring seal 29. The seal 29 prevents leakage of the fluid-filled chamber 9 passed the piston body 7 between the sleeve 19 and the bore of the piston housing 10. Instead, any fluid flow is diverted between the sleeve 19 and the piston body 7 (see FIG. 3A).

The bottom sub 20 defines a chamber 9*b* that functions, in use, as a continuation of the fluid chamber 9 of the piston housing 10, being in fluid communication with the chamber 9 via the metering sleeve 19 when the piston body 7 moves upwardly away from its snap ring 30 sealed seat on the upper end of the bottom sub 20.

The fluid chamber 9*b* of the bottom sub 20 has its lower, in use, end, defined by a balance piston 32. This balance piston 32 is longitudinally slidably received within the bore of the bottom sub 20, sealed against the bore with O-ring seals 34*a,b* and resiliently biassed toward the piston body 7 by a compression spring 35. The opposing side of the balance piston 32 is exposed to ambient downhole pressure via lateral ports 36. The balance piston 32 serves to efficiently accommodate any thermal expansion of the fluid in the fluid chamber 9 enhancing reliability of operation of the jar mechanism and enabling easier re-latching of the jar rod 2.

When an upward jarring force is to be exerted by the jar 1 the jar rod 2 is pulled in the direction shown by the arrow 25 in FIG. 1. The pulling force exerted on the jar rod 2 is transmitted to the piston via the latch key 3 and the latch sub 4 so that the piston 5 is moved through the fluid chamber 9 against the resistance of the fluid.

Figure 3A:
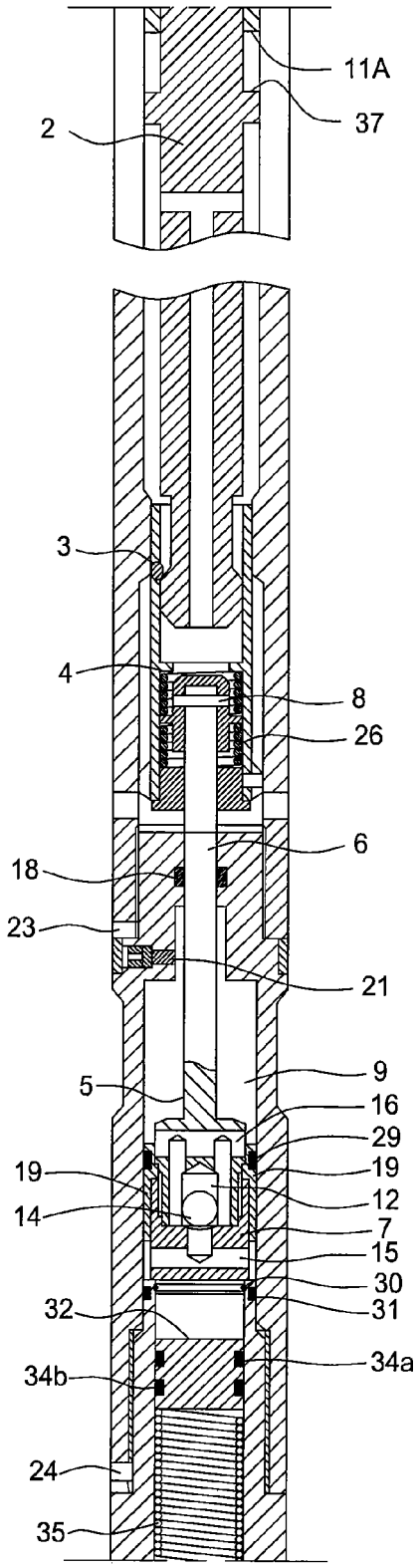
FIG. 3A is a schematic sectional view corresponding to FIG. 1.

This is achieved by the restricted/metered flow of the fluid 11 between the piston body 7 and the annular fluid metering sleeve 19 that is mounted around the piston body 7 as can be seen in the schematic diagram of FIG. 3A. Fluid is prevented from passing through the passage ways 15, 16 and chamber 12 in the piston 5 by blockage of the passage way 15 by the ball 14.

Figure 3B:
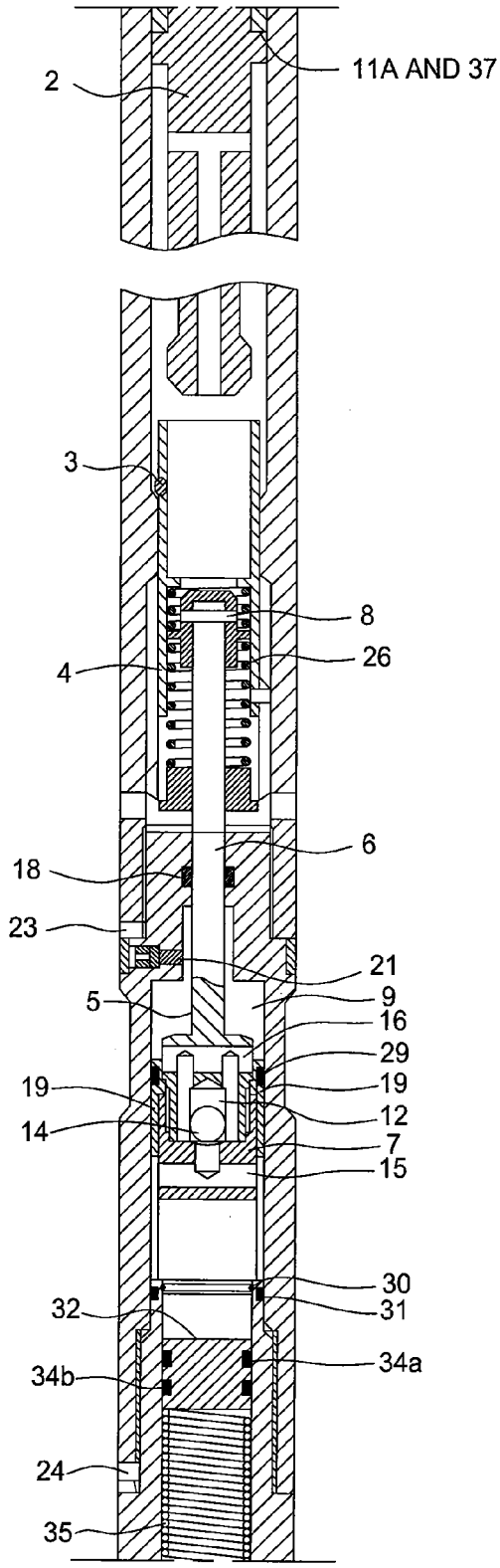
FIG. 3B is a schematic sectional view corresponding to FIG. 3A but with the mechanism at the point at which the jar rod has been released and impacted against the anvil end of the housing.

As the movement of the piston 5 and the jar rod 2 is slow due to restricted fluid flow there-passed, time is available to pull up to a desired pull force before the piston 5 reaches the other end of the fluid chamber 9. Continuation of the pulling force in the direction of the arrow 25 on the jar rod 2 forces the latch key 3 out of engagement with the jar rod 2 and into engagement with the main housing 22 so that the jar rod 2 is released from the piston 5 and rapidly accelerates until a shoulder 37 at its upper end hits the anvil shoulder 11*a* of the anvil sub 11 that is secured at the top end of the main body housing 22 by grub screw 28. When this occurs (see FIG. 3B) an upward jarring force is exerted on the toolstring to which the jar 1 is attached.

After the jarring force has been produced the jar rod 2 is returned to the latch sub 4 by application of a downward force to the jar rod 2. The latch sub 4, the latch key 3 and the piston 5 are maintained in the release position by means of helical spring 26 which enables the jar rod 2 to be inserted back into the latch sub 4.

Continued application of the downward force forces the latch key 3 to re-engage with the jar rod 2 and forces the piston 5 to return to the primed position against the action of the helical spring 26.

When the piston 5 is being returned to the primed position the force of the fluid entering into the passage way 15 in the piston body 7 forces the ball 14 into the middle of the chamber 12 so that fluid may pass through the chamber 12 into the passage way 16 and into the chamber 9 on the other side of the piston 5. Hence the ball 14 acts as a one way valve so that the resistance against movement of the piston is high when the piston moves from the primed position to the unprimed position but is very low when the piston moves from the unprimed position to the primed position. This enables the piston 5 to be easily returned to the primed position after the jarring force has been produced.

By constructing the jar mechanism so that the jar rod 2 and the piston 5 are separable this mitigates against the disadvantages of conventional jar mechanisms, locating the fluid only in the vicinity of the piston and avoiding the need for fluid seals around the jar rod 2. This configuration also avoids the disadvantages of a mechanical jar as it is not necessary to remove the toolstring from the borehold in order to adjust the jarring force. The jarring force exerted by the jar rod 2 is dependent on the force with which the jar rod and piston 5 are pulled from the first position to the second position and therefore is only dependent on the maximum pulling force available on site at the oilfield.

Figure 2:
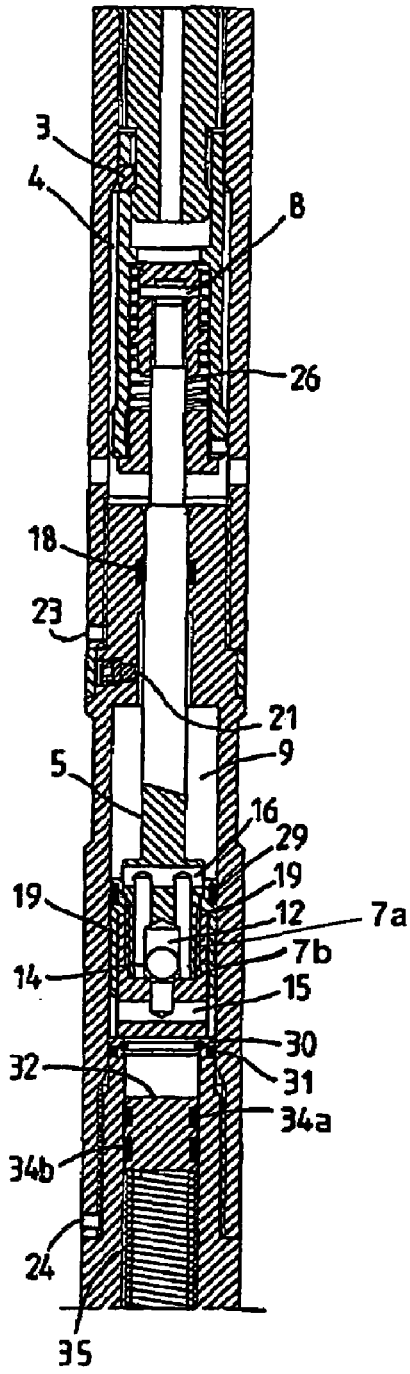
FIG. 2 is an enlarged view of the part of the tool in FIG. 1 encircled by a broken line.
Figure 4:
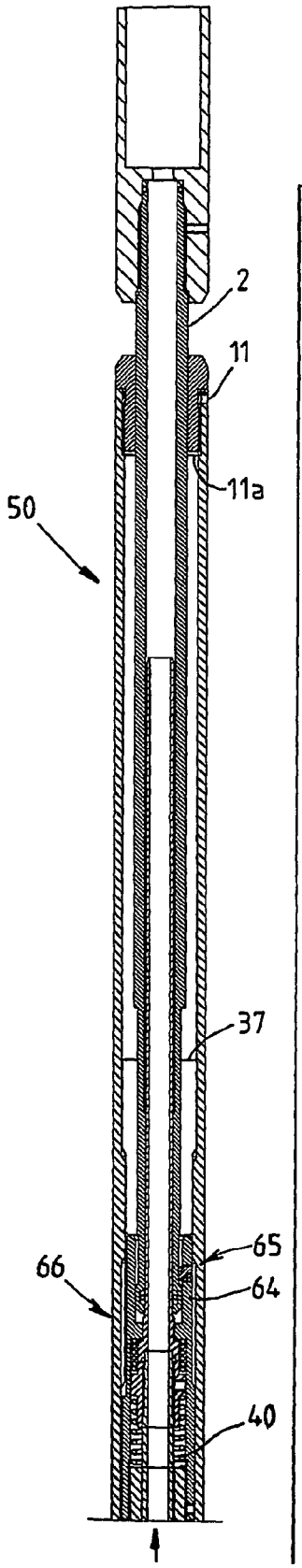
FIG. 4 is a longitudinal sectional view of a second preferred embodiment of upstroke jar being a pump through jar for coil tubing operations and showing the jar mechanism in the primed position.
Figure 4:
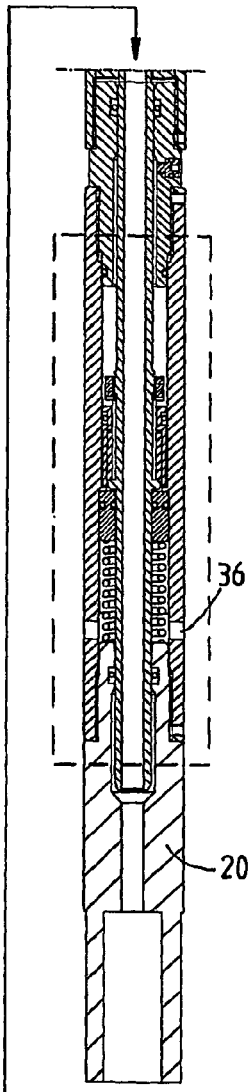
Figure 5:
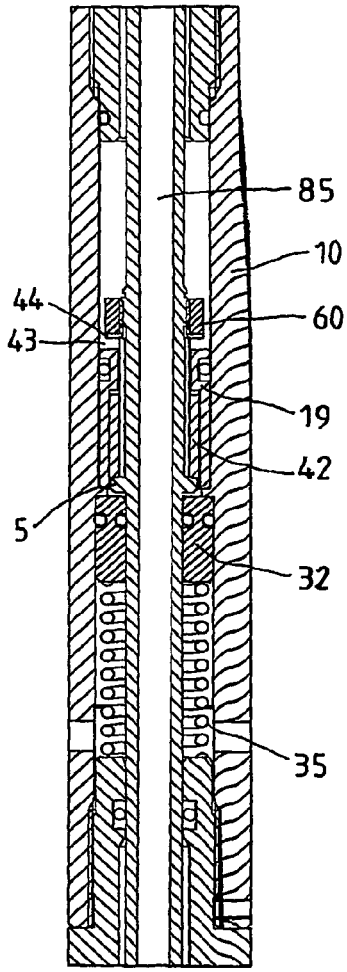
FIG. 5 is an enlarged view of the part of the tool in FIG. 4 encircled by a broken line.

FIGS. 4 and 5 show an example of an upstroke jar for use in coil tubing operations. The upstroke jar 50 works in a similar manner to the upstroke jar 1 and the parts of the upstroke jar 5 which are similar to the upstroke jar 1, shown in FIGS. 1 to 3 have the same reference numerals.

However, the upstroke jar 50 has a bore 85 through its entire length which enables fluid to be pumped through the jar 50 so that the jar may be used in coil tubing operations.

Another difference between the upstroke jar 50 and the upstroke jar 1 is the design of the piston 5. In the upstroke jar 50 the piston 5 comprises a one piece piston 5 encircled not only by an annular metering sleeve 19 but also by a by-pass sleeve 42 which nests against the metering sleeve 19. The bypass sleeve 42 serves the same function as the one-way ball valve 14 of the first embodiment but within the annular chamber surrounding the central hollow piston 5, thereby leaving the axial bore 85 unobstructed at all times, unlike the first embodiment. The piston 5 has flutes or channels 43 spaced around the external surface of the portion of the piston section 37 on which the by-pass sleeve 42 is located. Corresponding flutes or channels 44 are also provided in an annular sleeve retainer 60 that is provided to hold the annular metering sleeve 19 captive on the piston 5. The retainer 60 is demountable to enable demounting of the metering sleeve 19 if desired for maintenance. The flutes or channels 42, 43 allow for the flow of the fluid passed the by-pass sleeve 42 when re-setting the jar.

The upstroke jar 50 has a release and re-engagement mechanism 66 for connecting the piston 5 to the jar rod 2 that is analagous to that of the first embodiment, having a latch key housing 64 and latch key 65.

In use, when a force is applied to the jar rod 2 of the upstroke jar 50 in the direction shown by the arrow 25 the piston 5 is pulled along the piston chamber 9. The metering sleeve 19, however remains relatively static through drag from its O-ring against the piston housing, leading to the movable by-pass sleeve 42 being acted upon by a shoulder of the metering sleeve 19. The by-pass sleeve is directly forced against a seat at the shoulder 57 of the piston, preventing fluid in the piston chamber 9 from flowing through the channels 43, 44 to the other side of the piston. Hence, the large strain force is built up on the jar rod 2 before the piston 5 is able to more freely from one end to the other end of the piston chamber 9.

When the piston 5 reaches the other end of the piston chamber 8 the force exerted by the jar rod 2 pushes the latch key 3 out of engagement with the jar rod 2 to enable the jar rod 2 to be released from the housing 4. This causes the jar rod 2 to move rapidly upwards to exert an upward impact force on the top anvil sub at the top of the upstroke jar.

As with the first embodiment, in the second embodiment the annular metering sleeve 19 meters through the fluid in the fluid chamber from one side of the piston to the other at a sufficiently slow rate to allow for the accumulation of a desired level of strain on the jar rod 2. Fluid is prevented from passing the metering sleeve at faster rates via the bypass sleeve 42, since the bypass sleeve 42 seats out on the piston 5 as soon as the jar rod 2 is pulled and unseats only when the jar rod 2 is subsequently pushed down to facilitate re-latching of the mechanism. The re-latching also causes the piston 5 to return to the primed position against the action of a helical spring 40.

Figure 6:
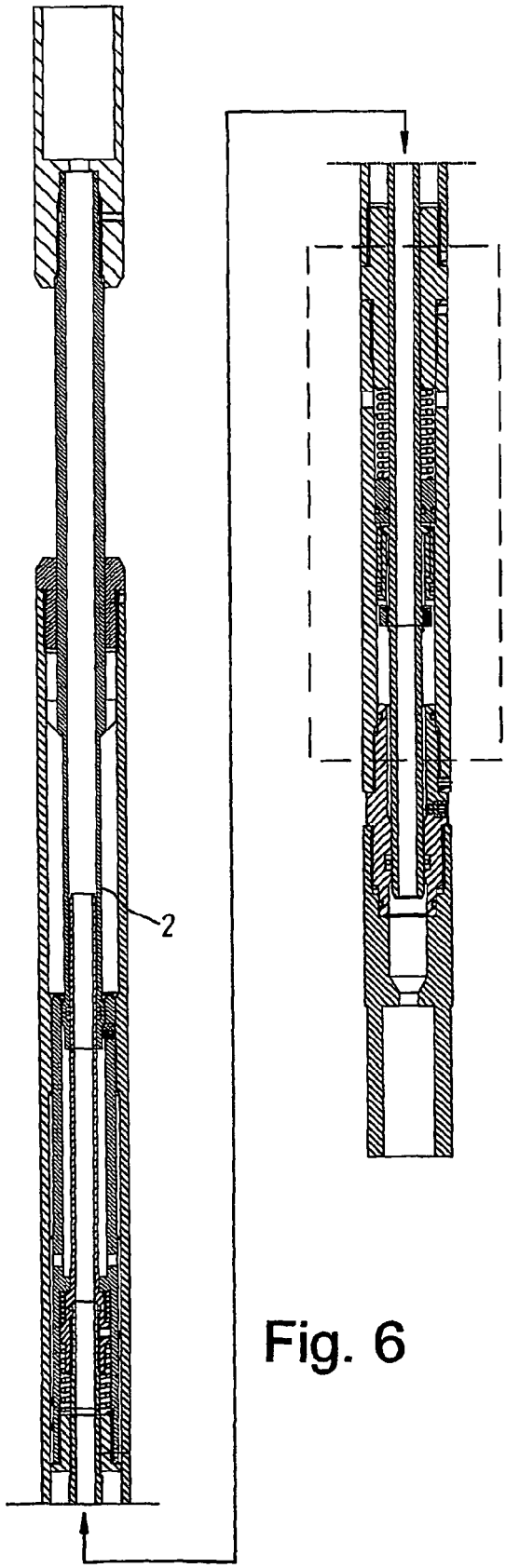
FIG. 6 is a longitudinal sectional view of a third preferred embodiment of jar, being a downstroke jar suitable for use with coil tubing that, unlike wireline, may be pushed to apply a pushing force to the jar rod and showing the jar mechanism in the primed position.
Figure 7:
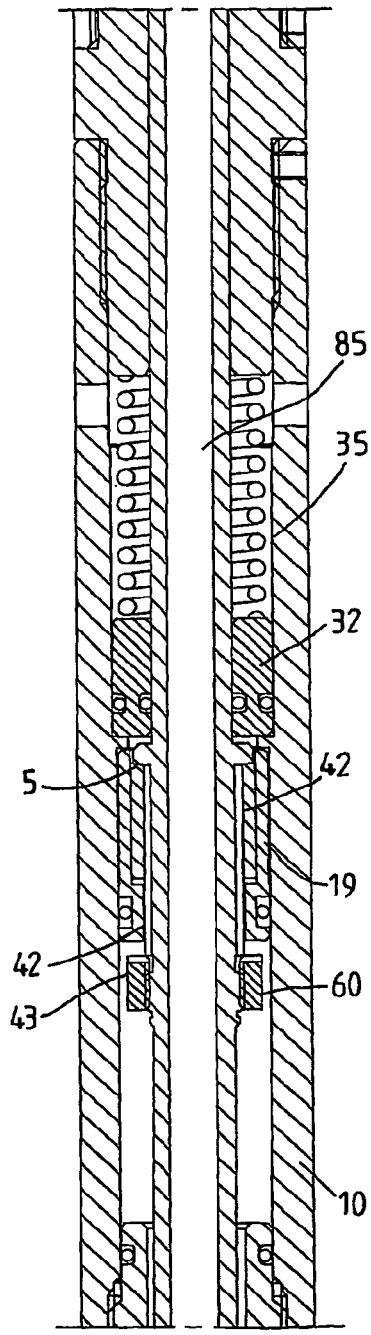
FIG. 7 is an enlarged view of the part of the tool in FIG. 6 encircled by a broken line.

Although in the first and second embodiments above the force to be imparted by the jar rod is a pulling force, the invention is equally applicable to application of a pushing force to strike an anvil of the body and generate the necessary jarring impact. In the embodiment of FIGS. 6 and 7 such a "downstroke" jar is shown. As will be appreciated, the componentry of the jar is substantially the same as for the preceding embodiment but with the mechanism simply working in reverse.

By way of a further alternative embodiment, the facility of an upstroke jar as per the second embodiment of FIGS. 4 and 5 may be combined in tandem with the downstroke jar of the FIGS. 6 and 7 embodiment to create a dual stroke jar, as shown in FIG. 10, which may be operated firstly by a downstroke pushing force and then by an upstroke pulling force or vice versa.

By virtue of the independent annular metering sleeve of the present invention reliably accurate metering of the fluid flow to establish the desired strain force may be achieved. Furthermore, manufacture of the equipment is relatively economical. No burnishing of the tool bore is required. The metering sleeve may be used interchangeably from one jar mechanism to another and may be pre-formed to suit the desired rate of meter flow.

The balance piston of the present invention substantially improves operational efficiency and ease of use of the jar. It accommodates any expansion of the fluid/oil (which would otherwise represent a major problem under certain circumstances) and, being spring loaded, the piston automatically returns on cooling. Furthermore, the balance piston reduces the number of seals which are needed around the piston, making the re-latching smoother.

Referring to FIGS. 8 and 9, these show a configuration of jar mechanism in which the jar rod 2' is provided with an a circular cross-section for part of its length in order to co-operatively engage with a correspondingly a circular part of the bore of the anvil sub 11'.

As will be seen from FIG. 8B, the anvil sub 11' has a reduced diameter aperture 100 at its end through which the jar rod 2' enters/exits the anvil sub 11' and which is a circular in shape having radially opposing flat portions 200 whereby the shape is complementary to part of the shaft of the jar rod 2'. Each of the opposing flat facets 200 is provided with a longitudinal recess/channel 201.

As can be seen from FIGS. 9A and 9B, part of the length of the shaft of the jar rod 2 has complementary facets 202 to the facets 200 of the anvil sub 11' whereby when the jar rod 2' is moved longitudinally of the anvil sub 11' to bring the facets 202 of the jar rod 2' into correspondence with the facets 200 of the anvil sub 11', they will co-operatively engage to enable any torque applied to the jar rod 2' to be transmitted to the anvil sub 11'.

The recesses or channels 201 allow fluid to by-pass the region of complementary engagement between the jar rod 2' and anvil sub 11' around the outside of the jar rod 2'.

The invention claimed is:

1. A jar mechanism which comprises:

a housing having a fluid chamber therein containing a fluid;

a piston movably mounted in the fluid chamber for movement between a first position and a second position;

a jar member movably mounted in the housing; and whereby a push force exerted on the jar member moves the piston from the first position to the second position within the fluid chamber against the resistance of the fluid, and the action of the push force exerted on the jar member actuates a release device, the jar member being releasably coupled to the piston by the release device such that when the piston is in the first position in the fluid chamber the jar member is coupled to the piston by the release device for movement therewith and actuation of the release device enables the jar member to be uncoupled from the piston, wherein the piston is retained in the second position by a retainer member when the jar member is uncoupled from the piston; and a balance piston facing the fluid in the fluid chamber and which operates to accommodate for any expansion of the fluid.

2. The jar mechanism of claim 1, wherein the jar member is a jar rod having a shaft with an a circular cross section to at least part of the shaft and wherein the jar rod shaft passes into an anvil sub of the jar mechanism through an aperture in the anvil sub, the part of the jar rod having an a circular cross section being able to lodge against one or more shoulders of the anvil sub whereby a turning force applied to the jar rod may be transmitted to the anvil sub.

3. The jar mechanism of claim 2, wherein the aperture of the anvil sub through which the jar rod shaft passes into the anvil sub has a bore with a corresponding shape to the shape of the a circular cross section part of the jar rod shaft.

4. The jar mechanism of claim 2, wherein the a circular cross section part of the jar rod shaft extends for only part of the length of the jar rod shaft whereby the jar rod shaft is able to engage with the anvil sub only for a part of the range of axial positions of the jar rod relative to the anvil sub.

5. The jar mechanism of claim 2, wherein the jar rod shaft and anvil sub have complementary shapes to co-operatively engage for transmission of torque and one or both of the jar rod shaft and anvil sub are provided with one or more longitudinal channels to allow for bypass of fluids.

6. A jar mechanism, comprising:

a first housing having a first sealed fluid chamber containing a fluid and a second housing having a second sealed fluid chamber containing a fluid;

a first piston movably mounted in the first fluid chamber for movement between a first and second position within the first fluid chamber and a second piston movably mounted in the second fluid chamber for movement between a first position and a second position within the second fluid chamber;

a first jar member axially movably mounted in the first housing and axially movable with respect to the first housing, wherein the first jar member includes a shoulder disposed within the first housing for hitting a corresponding portion of the first housing and a second jar member axially movably mounted in the second housing and axially movable with respect to the second housing, wherein the second jar member includes a shoulder disposed within the second housing for hitting a corresponding portion of the second housing;

a first annular metering sleeve disposed in the first fluid chamber around the first piston thereby dividing the first fluid chamber into a first and second side within the first fluid chamber, wherein clearance between the bore of the first metering sleeve and the outside diameter of the first piston is sized to meter flow of the fluid from the first side to the second side of the first fluid chamber and a second annular metering sleeve disposed in the second fluid chamber around the second piston, thereby dividing the second fluid chamber into a first and second side within the second fluid chamber, wherein clearance between the bore of the second metering sleeve and the outside diameter of the second piston is sized to meter flow of the fluid from the first side to the second side of the second fluid chamber;

a first release device releasably coupling the first jar member to the first piston and configured to release the first jar member from the first piston when the first piston is in the second position within the first fluid chamber and a second release device releasably coupling the second jar member to the second piston, and configured to release the second jar member from the second piston when the second piston is in the second position within the second fluid chamber;

whereby a push force exerted on the first jar member moves the first piston from the first position to the second position within the first fluid chamber against the resistance of the fluid and actuates the first release device; and whereby a pull force exerted on the second jar member moves the second piston from the first position to the second position within the second fluid chamber against the resistance of the fluid and actuates the second release device.

7. The jar mechanism of claim 6, wherein the first jar member being releasably coupled to the first piston by the first release device such that when the first piston is in the first position within the first fluid chamber the first jar member is coupled to the first piston by the first release device for movement therewith and actuation of the first release device enables the first jar member to be uncoupled from the first piston.

8. The jar mechanism of claim 6, wherein the second jar member being releasably coupled to the second piston by the second release device such that when the second piston is in the first position within the second fluid chamber the second jar member is coupled to the second piston by the second release device for movement therewith and actuation of the second release device enables the second jar member to be uncoupled from the second piston.

9. The jar mechanism of claim 6, wherein the first piston includes a first one way valve configured to open and allow substantially unmetered fluid flow between the sides of the first fluid chamber when the first piston moves from the second to the first position within the first fluid chamber and the second piston includes a second one way valve configured to open and allow substantially unmetered fluid flow between the sides of the second fluid chamber when the second piston moves from the second to the first position within the second fluid chamber.

10. The jar mechanism of claim 9, wherein the first one way valve includes a first ball and first seat and the second one way valve includes a second ball and second seat.

11. The jar mechanism of claim 6, wherein the first release device and second release device are configured to enable recoupling of the first jar member to the first piston and the second jar member to the second piston, respectively, when the first piston moves from the second to the first position within the first fluid chamber and the second piston moves from the second to the first position within the second fluid chamber, respectively.

12. The jar mechanism of claim 6, further comprising a first biasing member to retain the first piston in the second position within the first fluid chamber when the first jar member is uncoupled from the first piston and a second biasing member to retain the second piston in the second position within the second fluid chamber when the second jar member is uncoupled from the second piston.

13. The jar mechanism of claim 6, further comprising a first balance piston and a second balance piston facing the fluid in the first fluid chamber and the second fluid chamber, respectively, in order to accommodate for any expansion of the fluid.

14. The jar mechanism of claim 6, wherein the first jar member includes a first jar rod having a first shaft with an a circular cross section to at least part of the first shaft for engagement with one or more shoulders of a first anvil sub of the jar mechanism and the second jar member includes a second jar rod having a second shaft with an a circular cross section to at least part of the second shaft for engagement with one or more shoulders of a second anvil sub of the jar mechanism.

15. The jar mechanism of claim 14, wherein the a circular cross section part of the first jar rod shaft extends for only a portion the first jar rod shaft whereby the first jar rod shaft is able to torsionally engage with the first anvil sub only for a part of the range of axial positions of the first jar rod relative to the first anvil sub and the a circular cross section part of the second jar rod shaft extends for only a portion the second jar rod shaft whereby the second jar rod shaft is able to torsionally engage with the second anvil sub only for a part of the range of axial positions of the second jar rod relative to the second anvil sub.

16. A method of delivering an impact force upwardly and downwardly by a jar mechanism, the method comprising:

pushing on a first jar member that moves a first piston from a first position to a second position within a first fluid chamber against the resistance of a fluid controlled by a first metering sleeve, the first jar member being releasably coupled to the first piston by a first release device;

storing a first potential energy in the jar mechanism;

actuating the first release device that enables the first jar member to be uncoupled from the first piston;

delivering an impact force downwardly by the first jar member onto a corresponding portion of a jar housing;

pulling on a second jar member that moves a second piston from a first position to a second position within a second fluid chamber against the resistance of a fluid controlled by a second metering sleeve, the second jar member being releasably coupled to the second piston by a second release device;

storing a second potential energy in the jar mechanism;

actuating the second release device that enables the second jar member to be uncoupled from the second piston; and delivering an impact force downwardly by the second jar member onto a corresponding portion of the jar housing.

17. A jar mechanism which comprises:

a housing having a fluid chamber therein containing a fluid;

a piston movably mounted in the fluid chamber for movement between a first position and a second position;

a jar member movably mounted in the housing; and a release device releasably coupling the jar member to the piston;

whereby a push force exerted on the jar member moves the piston from the first position to the second position within the fluid chamber against the resistance of the fluid, and the action of the push force exerted on the jar member actuates the release device, the jar member being releasably coupled to the piston by the release device such that when the piston is in the first position in the fluid chamber the jar member is coupled to the piston by the release device for movement therewith and actuation of the release device enables the jar member to be uncoupled from the piston, the piston being encircled by an annular metering sleeve allowing metered flow of the fluid in the fluid chamber from one side of the piston to the other via the annular metering sleeve, the clearance between the bore of the metering sleeve and the outside diameter of the piston determining the level of resistance to movement of the jar member while the jar member is coupled to the piston, wherein the jar mechanism comprises means to retain the piston in the second position when the jar member is uncoupled from the piston.

18. The jar mechanism of claim 17, wherein the piston includes a one way valve which closes and prevents unmetered fluid flow past the piston when the piston moves from the first to the second position, but which opens and allows fluid to flow relatively freely past the piston when the piston moves from the second to the first position.

19. The jar mechanism of claim 18, wherein said one-way valve comprises a chamber which communicates with the fluid on either side of the piston and inside the chamber is located a spherical member which prevents fluid passing the chamber when the piston moves from the first position to the second position, but which permits fluid to pass through the chamber when the piston moves from the second position to the first position.

20. The jar mechanism of claim 17, wherein the release device is movably mounted on the piston for movement between an engagement position and a release position and the release device is typically biased to an intermediate position, between the engagement and the release positions, and whereby the jar member may be uncoupled from the piston when the release device is in the release position and the piston is in the second position and whereby the jar member may be recoupled to the piston when the release device is in the engagement position and the piston is in the first position.

21. The jar mechanism of claim 17, wherein when a force opposite to the force exerted on the jar member to move the piston from the first position to the second position is applied to the jar member, the jar member causes the release device to move to the engagement position and the piston is moved from the second to the first position so that the release device couples the piston to the jar member.

* * * * *